US006260289B1

(12) United States Patent
Tsuji

(10) Patent No.: US 6,260,289 B1
(45) Date of Patent: Jul. 17, 2001

(54) SOLE, AND SHOE AND SANDAL INCLUDING THE SAME

(75) Inventor: Hiroaki Tsuji, Haga 5116-98, Okayama-shi, Okayama-ken 701-1221 (JP)

(73) Assignees: Ayako Yamazaki, Osaka; Hiroaki Tsuji, Okayama, both of (JP)

( * ) Notice: Subject to any disclaimer, the term of this patent is extended or adjusted under 35 U.S.C. 154(b) by 0 days.

(21) Appl. No.: 09/478,801

(22) Filed: Jan. 7, 2000

(30) Foreign Application Priority Data

Oct. 27, 1999 (JP) ..... 11-230062

(51) Int. Cl.[7] ..... A43B 13/00

(52) U.S. Cl. ..... 36/103; 36/25 R; 36/28; 36/31; 36/143; 36/144; 36/11.5

(58) Field of Search ..... 36/103, 110, 132, 36/25 R, 28, 31, 142, 143, 144, 11.5, 140

(56) References Cited

PUBLICATIONS

"Talk on Feet" by Shiro Kondo et al. pp. 90–93, 1982. Discussed in the spec.

"Kapandji Physiology of Joints" by Kapandji; pp. 134–135; 148–149; 204–205. Discussed in the spec.

"The Shoe and foot New Medical Study" by Tadao Ishizuka et al.; pp. 42–47. Discussed in the spec.

"The Range of Joint Motions of the Extremities in Healthy Japanese People—The Difference According to the Age" by Watanabe et al.; vol. 53, No. 3, Mar. 25, 1979. Discussed in the spec.

*Primary Examiner*—Ted Kavanaugh
(74) *Attorney, Agent, or Firm*—Armstrong, Westerman, Hattori, McLeland & Naughton, LLP

(57) ABSTRACT

A sole capable of smoothly performing aori motion while absorbing a shock on a foot when the foot touches the ground with the outer side thereof is obtained. This sole comprises a central surface, a front bottom surface and a rear bottom surface. The central surface is formed substantially parallel to the bottom of the foot, and the front bottom surface has a first angle of inclination with respect to the central surface. The rear bottom surface has a second angle of inclination with respect to the central surface. A first elastic layer made of a material having higher flexibility as compared with the remaining portions is provided on the outer side of the boundary between the central surface and the front bottom surface to extend over the boundary. Thus, the first elastic layer smoothly deforms with a load when the central surface touches the ground, whereby aori motion can be smoothly performed while absorbing a shock on the foot when the foot touches the ground with the outer side thereof.

7 Claims, 15 Drawing Sheets

SOLE, AND SHOE AND SANDAL INCLUDING THE SAME

BACKGROUND OF THE INVENTION

1. Field of the Invention

The present invention relates to a sole, and a shoe and a sandal including the same, and more particularly, it relates to a sole having a plurality of bottom surfaces, and a shoe and a sandal including the same.

2. Description of the Prior Art

In general, normal articular movements and muscular activity enable natural action of a human body. It is well known that hypofunction results when normal articular movements are limited or muscles are not used.

An average man of today, generally protecting his feet with shoes and walking on a flat and hard paved road, is restrained from natural pedal motion. Consequently, the pedal function deteriorates and the muscles of lower extremities get weak with no requirement for adaptability to uneven ground. While exercise such as jogging or walking is necessary in order to prevent the lower half of the body from weakening and develop physical strength, most people cannot take time for exercise.

An infant naturally stands or walks on tiptoe or with the heels in the process of development. A general infant naturally takes such action in the process of growth/development in an untaught manner. The infant acquires new functions one after another by repeating such natural action. The motion observed in such action of.the infant is classified into two elements, i.e., acquired "natural motion" and "specific motion" for training the same.

In practice, a patient suffering from paralysis of the lower half of the body as an after effect of cerebral apoplexy or the like and having difficulty in walking starts moving his ankles similarly to the process of development of an infant as functional training. Then he trains for standing and thereafter for walking so that he can walk on an uneven road in a well-balanced manner. In the functional training, the patient generally makes a series of movements he has naturally made in the process of development as described above.

Thus, it is conceivable that a sole with which everybody can naturally prevent his foot from weakening or recover the pedal function in daily life with reference to the movements in the process of human growthdevelopment is preferable.

A shoe must be so developed as not to hinder the foot of a person wearing the same from natural motion, to compensate for weak points of the foot resulting from anatomical characteristics and to add new advantages. Such features are obtained not by mere trial and error or experience but by detailed scientific study on feet and shoes. Combination of materials, combination of structures or to what portion of the shoe (what portion of the foot) the combination is applied is an important factor, which can never be obtained by trial and error with no theory.

Theory in development of a shoe is now described with reference to three points, i.e., "natural motion of a foot", "movements of joints" and "weak points of a foot and limitation of articular excursions".

First, "natural motion of a foot" is described. Important natural motion of a foot includes motion of gripping a projecting portion of the ground with the foot in a standing position as shown in FIG. 15 and "aori" motion in barefooted walking as shown in FIG. 16. Further, it is important to absorb a shock and enlarge the surface touching the ground by deformation of a fatty layer of the heel when the touching the ground with the heel as shown in FIG. 17, although this cannot be regarded as motion. Particularly when obliquely touching the ground with the heel for turning around or walking on a curve as shown in FIG. 18, the deforming fatty layer most effectively absorbs a shock and enlarges the surface touching the ground.

As disclosed in "Talk on Feet" by Shiro Kondo, Iwanami Shinsho, 1982 (referred to as literature 1), "aori" motion in barefooted walking is a way of walking by rotating the foot inward for reducing energy consumption in walking thereby enabling long-sustained walking. In such aori motion, the heel touches the ground, the fibular margin of the foot touches the ground, the overall bottom of the foot touches the ground, the heel separates from the ground, the tiptoe supports the body weight and the foot kicks the ground while making motion from supination to pronation when touching the ground with the heel and then touching the ground with the overall bottom of the foot and making motion from pronation to supination when touching the ground with the overall bottom of the foot and then kicking the ground.

"Movements of joints" are now described. Principal joints concerned when a human stands, walks or runs are the hip joint, the knee joint, the ankle and the joints of the foot. According to "Kapandji Physiology of Joints" by Kapandji, Japanese translation supervised by Hideo Ogishima, Ishiyaku Shuppan, 1986 (referred to as literature 2), pp. 204 to 205, among these joints, the ankle and the joints of the foot coupling the leg and the foot so work that the human can stand, walk or run in conformity to inclination or unevenness of the ground.

The ankle (talocrural articulation), which is most important among the joints present in the metapodium, adjusts motion between the foot and the leg by the sagittal plane, and this motion is important for walking on level or uneven ground. On a basic position shown in FIG. 19A, the bottom of the foot is perpendicular to the long axis of the leg. Motion of the ankle includes dorsiflexion shown in FIG. 19B, plantar flexion shown in FIG. 19C, adduction shown in FIG. 20A, abduction shown in FIG. 20B, supination shown in FIG. 21A, pronation shown in FIG. 21B, and incycloduction and excycloduction shown in FIGS. 22A and 22B combining the same. The normal excursion of the ankle varies with scholars. While the inventor has heretofore regarded the normal excursion of the ankle as 20 degrees in supination and 40 degrees in pronation, it is conceivably proper in shoemaking to take the idea that the normal excursion is 20 degrees in supination and 30 degrees in pronation with individual variation of 20 degrees and 10 degrees respectively as described in literature 2, pp. 134 to 135.

While the foot includes a large number of complicated joints, important joints are the talocalcaneal joint (joint between the ankle bone and the calcaneus), the transverse tarsal joint (at the tarsal center), the tarsometatarsal joint, the cuboidal navicular joint and the cuneonavicular joint, and literature 2 describes in p. 148 that these joints have two functions.

The first function is to move the foot in relation to two axes other than the sagittal plane to correctly direct the bottom of the foot to the ground regardless of the position of the leg or inclination of the ground. In other words, the ankle adjusts motion on the sagittal plane, i.e., supination and pronation of the ankle.

The second function is to change the shape and the curve of the arch of the foot so that the foot properly fits unevenness of the ground. Thus, a buffer is inserted between the ground and the loaded foot, thereby making the stance phase flexible in walking.

"Weak points of a foot and limitation of articular excursions" is described. First, fatigue and trouble of the foot following pronation are described. These are disclosed in "The Shoe and Foot New Medical Study" by Tadao Ishizuka, Kanahara Shuppan, 1996 (referred to as literature 3), pp. 42 to 44.

FIG. 23 illustrates a line of a movement of the body weight as viewed from behind. Referring to FIG. 23, a calcaneus 101 is not linked on the same position as a tibia 102 but located outside the tibia 102, i.e., on a position closer to a fibula 104. Therefore, the body weight passes through the center of the tibia 102, moves outward on the ankle bone and reaches the calcaneus 101. However, the gravitational line straightly reaches the ankle bone downward from the tibia 102, and hence force of pronation acts on the calcaneus 101. Further, the arch slightly lowers upon application of a load, and hence the foot slightly pronates in walking as a matter of course. When walking or continuously standing for a long time, however, the foot is continuously loaded, to result in trouble as pes pronatus. This leads to tension of the muscle of the posterior part of the leg, pain on the ankle or the knee, tension of the Achilles' tendon or chronic pain on the overall foot.

In relation to this, FIG. 24 shows a sustentaculum (sustentaculum tali) 106, which is an important portion connecting the calcaneus 101 and an ankle bone 108, supporting most part of pressure applied to the overall body and distributing force to the heel and the propodium. This sustentaculum 106 serves as the prime mover for motion such as standing, walking, running or jumping. The sustentaculum 106 having a normal arch is stabilized on a position correctly at 90 degrees with respect to the long axis of the foot. The ankle bone 108, securely placed on the sustentaculum 106, is not tightly fixed onto a plane but consistently placed on a loose curve. Due to this structure, the calcaneus 101 swinging vertically, rotating or swinging transversely under the ankle bone 108 (see literature 2, pp. 158 to 159) is regarded as the portion most fatigued when walking.

Particularly when a woman wears high heels or the like for a long time, the heel and the toe support the body weight and hence the unsupported sustentaculum 106 is remarkably fatigued. Further, the sustentaculum 106 is inclined inward and cannot keep the position of 90 degrees due to lowering of the arch or pes pronatos, to cause tension on the ligament and inflame the talocalcanean joint, the talonavicular joint, the calcaneocuboid joint or the like (refer to literature 3, pp. 44 to 46).

As shown in FIG. 24, the sustentaculum 106 is located on a relative position of 22 to 28% from the heel in consideration of individual variation assuming that the distance between the heel (0%) and the toe is 100%.

When the body weight is put on a bare foot, a tuberosity of fifth metatarsal 112 comes into close contact with the ground to form a base for firmly supporting the body weight as shown in FIG. 25, while an articular surface 113 of a cuboid bone 110 comes into close contact with the tuberosity of fifth metatarsal 112 as shown in FIG. 26. When wearing a low heel 150 as shown in FIG. 27, however, the tuberosity of fifth metatarsal 112 separates from the ground not to function as the base for supporting the body weight, and the joint between the tuberosity of fifth metatarsal 112, the cuboid bone 110 and the ankle bone slightly opens. When wearing a high heel 151 as shown in FIG. 28, on the other hand, the joint between the tuberosity of fifth metatarsal 112, the cuboid bone 110 and the ankle bone largely opens to result in chronic tension on the ligament, leading to ache around the foot (refer to literature 3, pp. 46 to 47).

The tuberosity of fifth metatarsal 112 is located on a relative position of 35% to 41% in consideration of individual variation, assuming that the heel is 0% and the toe is 100%.

Limitation of the dorsiflexion excursion of the ankle is now described. FIGS. 29 and 30 illustrate changes of excursions of dorsiflexion and plantar flexion of the ankle with aging disclosed in "The Range of Joint Motions of the Extremities in Healthy Japanese People—The Difference According to the Age—" by Hideo Watanabe and three others, Nihon Seikei Geka Gakkai Zasshi, Vol. 53, No. 3, Mar. 25, 1979 (referred to as literature 4). Referring to FIG. 29 showing variation of dorsiflexion excursion with age, the dorsiflexion excursion reduces with aging after the age of 20. Referring to FIG. 30 showing variation of plantar flexion excursion with aging, the plantar flexion excursion remains substantially unchanged after the age of 20 up to the age of 60.

One of the factors limiting the dorsiflexion excursion of the ankle with aging resides in that the heel of a conventional shoe is on a position higher than that of the toe and the ankle of the foot of a person wearing such a shoe is regularly kept in the state of plantar flexion. As pointed out in literature 3, the position of the heel of a current heeled shoe is higher than that of the toe to bring a negative effect on the foot, change the balance of the foot regardless of the way of walking and break the mechanism of the foot naturally supporting the body.

Another factor resides in that an ordinary human often going up the stairs seldom goes up a slope on foot in ordinary environment although the ankle performs dorsiflexion when going up a slope on foot. Such limitation of dorsiflexion of the ankle results in stumbling and falling.

On the basis of the aforementioned theory in development of shoes, the inventor has proposed the structure of a sole enabling "aori" motion in Japanese Patent No. 2,791,658. More specifically, this sole enables aori motion by reducing the thickness of the outer side of a third bottom surface as compared with that of the inner side while increasing the width of the outer side as compared with the inner side for providing inclination from the inner side toward the outer side.

However, the aforementioned proposed sole, forcibly making the foot of a person wearing this sole to touch the ground with the outer side by reducing the thickness of the outer side of the third bottom surface as compared with that of the inner side, is insufficient in absorption of a shock applied when touching the ground with the outer side. Therefore, it is difficult to more smoothly perform aori motion with this sole.

In the aforementioned proposed sole, further, no consideration is made on shock absorption and enlargement of the surface touching the ground by deformation of the fatty layer of the heel and balance of plantar flexion and dorsiflexion of the ankle.

SUMMARY OF THE INVENTION

An object of the present invention is to provide a sole smoothly enabling aori motion while absorbing a shock on the foot of a person wearing the sole when touching the ground with the outer side of the bottom of the foot.

Another object of the present invention is to provide a sole having a function of absorbing a shock and enlarging the surface touching the ground similarly to the fatty layer of the heel of a person wearing the sole.

Still another object of the present invention is to provide a sole enabling well-balanced motion of plantar flexion and dorsiflexion of an ankle.

A sole according to the aspect of the present invention comprises a central surface, a front bottom surface and a rear bottom surface. The central surface is formed substantially parallel to the bottom of a foot, and the front bottom surface has a first angle of inclination with respect to the central surface. The rear bottom surface has a second angle of inclination with respect to the central surface. A first elastic layer made of material having higher flexibility as compared with the remaining portions is provided on the outer side of a first boundary between the central surface and the front bottom surface to extend over the boundary.

In the sole according to this aspect, the first elastic layer having higher flexibility as compared with the remaining portions is provided to extend over the first boundary between the central surface and the front bottom surface while the central surface, the front bottom surface and the rear bottom surface are formed at the aforementioned angles of inclination, so that the rear bottom surface touches the ground, then the first elastic layer deforms with a load to make supination, thereafter the body weight moves inward and finally front bottom surface kicks the ground while making supination for readily enabling the so-called "aori" motion of the foot. When the central surface touches the ground, further, the first elastic layer smoothly deforms with the load, whereby aori motion can be smoothly performed while absorbing a shock on the foot when touching the ground with the out side of the foot. In addition, the foot can grip a projecting portion of the ground with the first elastic layer.

In the structure of the sole according to the aforementioned aspect, second elastic layers made of a material having higher flexibility as compared with the remaining portions may be provided on the inner and outer end surfaces of the rear bottom surface. In this case, the second elastic layers function similarly to the fatty layer of the heel, thereby absorbing a shock and enlarging the surface touching the ground similarly to the fatty layer of the heel deforming in a bare state. Thus, aori motion can be more smoothly performed.

In the structure of the sole according to the aforementioned aspect, a vertical line from the sustentaculum of the foot to the ground and a vertical line from the tuberosity of fifth metatarsal of the foot to the ground are preferably located on the central surface. When the vertical line from the sustentaculum of the foot to the ground is located on the central surface, the central surface can support the sustentaculum supporting most part of pressure applied to the overall body thereby stably supporting the body weight when touching the ground with the central surface and the person wearing the sole can stand only with the central surface substantially parallel to the bottom of the foot. Further, the sustentaculum supported by the central surface in walking is stabilized on a position correctly at 90 degrees with respect to the long axis of the foot with a normal arch, whereby it is possible to effectively prevent the ligament from chronic tension leading to inflammation of the talocalcanean joint, the talonavicular joint, the calcaneocuboid joint or the like. When the vertical line from the tuberosity of fifth metatarsal of the foot to the ground is located on the central surface, the tuberosity of fifth metatarsal comes into close contact with the ground to form a base firmly supporting the body weight upon touching the ground with the central surface, whereby it is possible to stably support the body weight when touching the ground with the central surface and prevent the ligament from chronic tension when the tuberosity of fifth metatarsal separates from the ground.

In the structure of the sole according to the aforementioned aspect, the central surface is preferably provided in the range of at least 20% in length and not more than 45% in length assuming that the heel is 0% and the toe is 100% in the overall sole length. If the boundary between the central surface and the rear bottom surface is located on a position of not more than 20% and the boundary between the central surface and the front bottom surface is located on a position exceeding 45%, motion of dorsiflexion and plantar flexion is unbalanced. When the central surface is provided on a position within the range of at least 20% and not more than 45%, therefore, dorsiflexion and plantar flexion can be performed in a well-balanced manner.

In the structure of the sole according to the aforementioned aspect, the vertical line from the sustentaculum of the foot to the ground may be substantially located on the boundary between the central surface and the rear bottom surface, and the vertical line from the tuberosity of fifth metatarsal of the foot tot he ground may be substantially located on the boundary between the central surface and the front bottom surface. In this case, it is preferable that the boundary between the central surface and the rear bottom surface is located on a position of 22% to 28% in length and the boundary between the central surface and the front bottom surface is located on a position of 35% to 41% in length assuming that the heel is 0% and the toe is 100% in the overall sole length. the positions of the boundaries are so set that the vertical line from the sustentaculum of the foot to the ground is substantially located on the boundary between the central surface and the rear bottom surface and the vertical line from the tuberosity of fifth metatarsal of the foot to the ground is substantially located on the boundary between the central surface and the front bottom surface in consideration of that the vertical line from the sustentaculum of the foot to the ground is located on the position of 22% to 28% in consideration of individual variation and the vertical line from the tuberosity of fifth metatarsal of the foot to the ground is located on the position of 35% to 41% in consideration of individual variation.

In the structure of the sole according to the aforementioned aspect, it is preferable that the first angle of inclination of the front bottom surface is greater than the second angle of inclination of the rear bottom surface and the first angle of inclination of the front bottom surface is 1.2 times to twice the second angle of inclination of the rear bottom surface. It is also preferable that the maximum value of the first angle of inclination of the front bottom surface is 30 degrees of the normal plantar flexion excursion of the ankle and the maximum value of the second angle of inclination of the rear bottom surface is 20 degrees of the normal dorsiflexion excursion of the ankle. In this case, dorsiflexion and plantar flexion can be performed in a well-balanced manner.

A shoe according to another aspect of the present invention includes the sole according to the aforementioned aspect.

A sandal according to still another aspect of the present invention includes the sole according to the aforementioned aspect.

Also when applying the sole according to the aforementioned aspect to a sandal, the first elastic layer smoothly deforms with the load when the central surface touches the ground, whereby aori motion can be smoothly performed while absorbing a shock on the foot when touching the ground with the outer side of the foot, and the foot can grip a projecting portion of the ground.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

Figure 1:
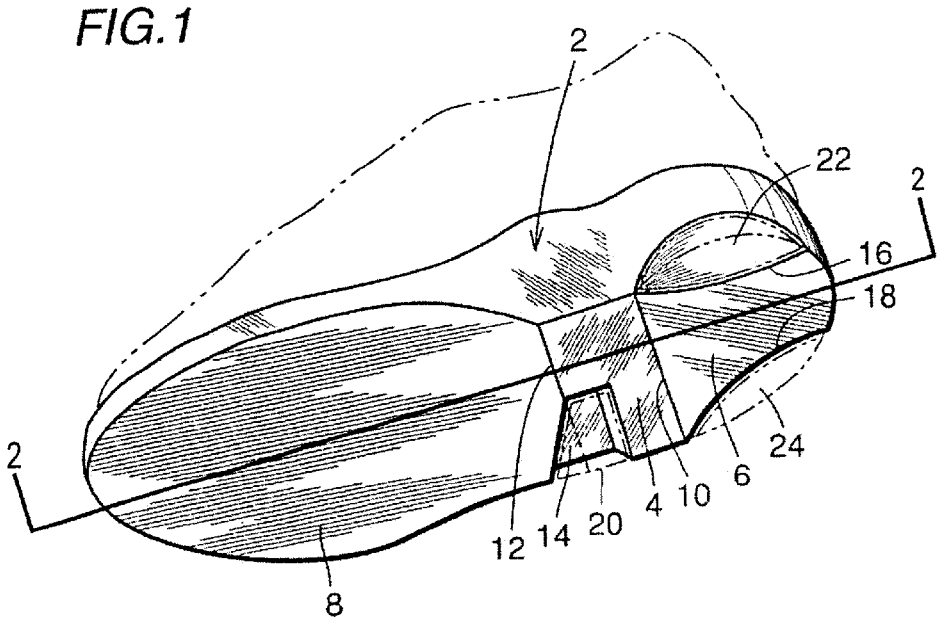
FIG. 1 is a perspective view showing a sole for a right foot according to a first embodiment of the present invention.
Figure 2:
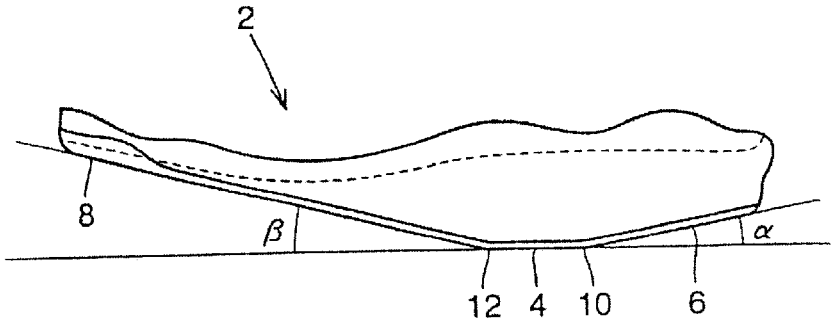
FIG. 2 is a side elevational view of the sole according to the first embodiment shown in FIG. 1.
Figure 3:
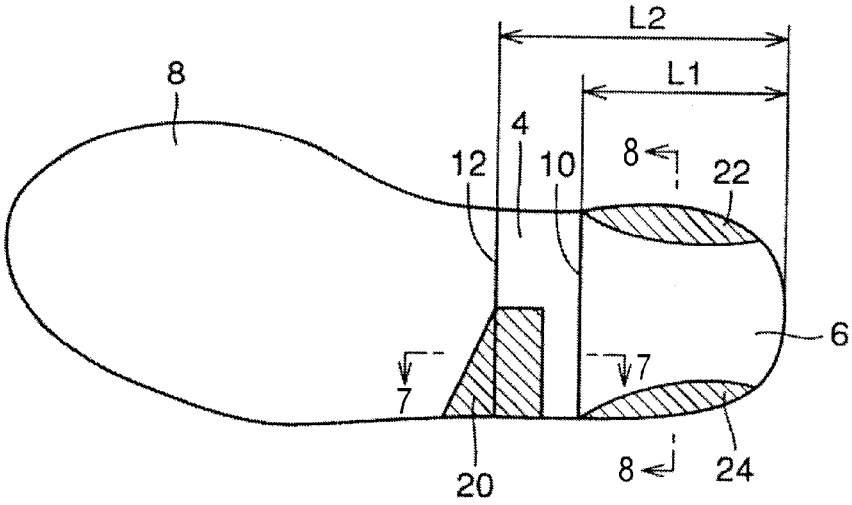
FIG. 3 is a bottom plan view of the sole according to the first embodiment shown in FIG. 1.

Referring to FIGS. 1 to 3, a sole 2 according to a first embodiment of the present invention is three-dimensionally formed by three surfaces having areas capable of stably supporting body weight. More specifically, the sole 2 according to the first embodiment comprises a central surface 4 substantially parallel to the bottom of a foot, a rear bottom surface 6 having a certain constant angle $\alpha$ of inclination with respect to the central surface 4 and a front bottom surface 8 having a constant angle $\beta$ of inclination with respect to the central surface 4. The relation between the angles $\alpha$ and $\beta$ of inclination is $\alpha<\beta$, and the ratio $\beta/\alpha$ is 1.2 to 2.0, more preferably about 1.5. The maximum value of the angle $\beta$ of inclination is 30 degrees of the normal plantar flexion excursion of the ankle, and the maximum value of the angle $\alpha$ of inclination is 20 degrees of the normal dorsiflexion excursion of the ankle. When any one of these three surfaces 4, 6 and 8 touches the ground, therefore, the remaining two surfaces are not in contact with the ground.

Figure 24:
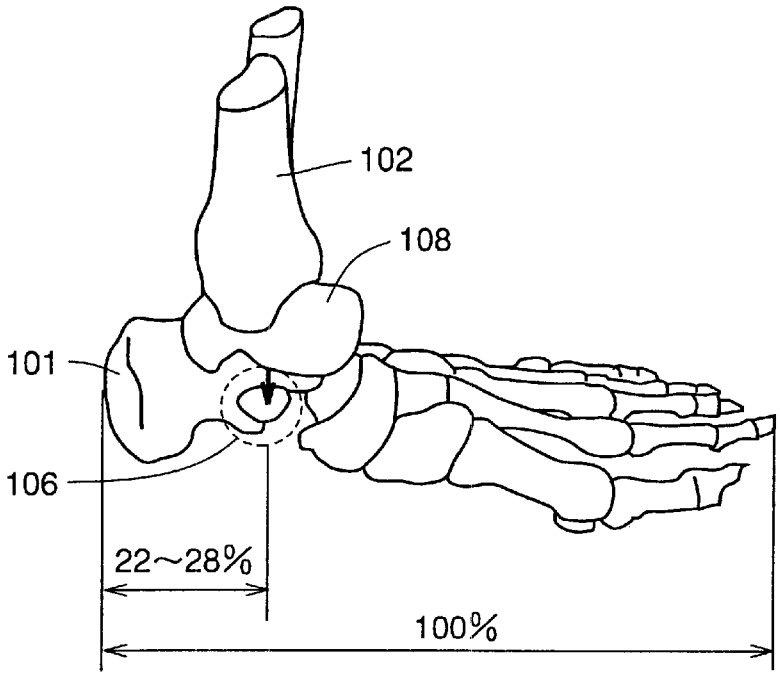
FIG.24 PRIOR ART
FIG. 24 is a schematic diagram for illustrating the sustentaculum of the conventional foot.
Figure 25:
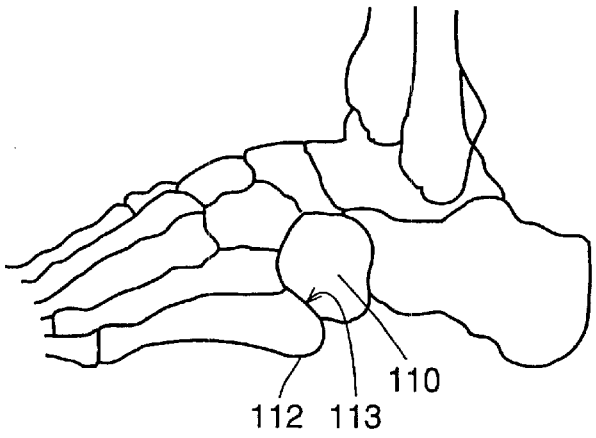
FIG.25 PRIOR ART
FIGS. 25 and 26 are schematic diagrams for illustrating states of the tuberosity of fifth metatarsal depending on positions of the conventional foot.
Figure 26:
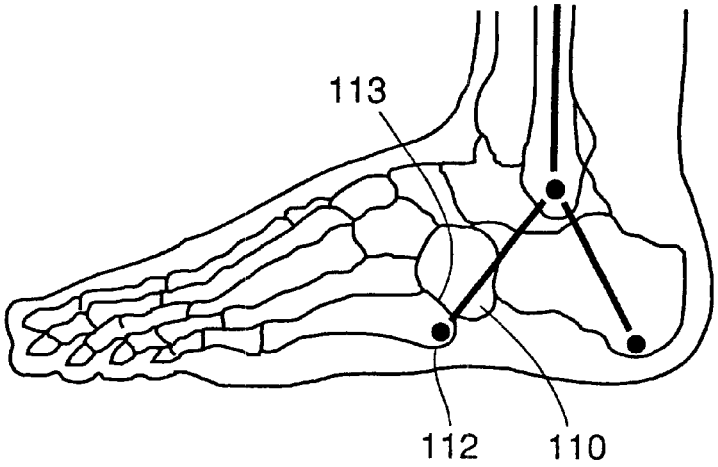
FIG.26 PRIOR ART
Figure 27:
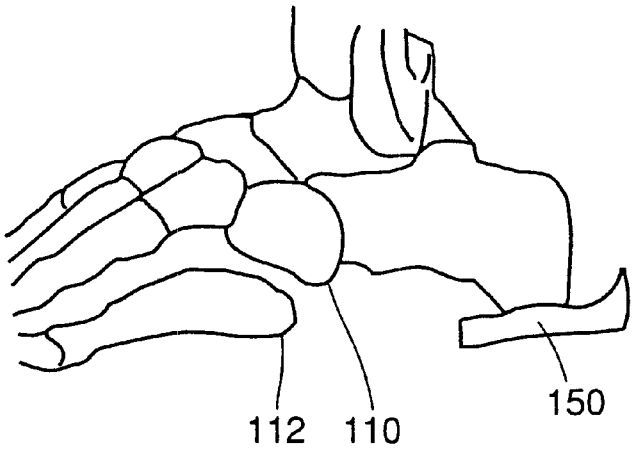
FIG.27 PRIOR ART
FIG. 27 is a schematic diagram for illustrating a state of the tuberosity of fifth metatarsal the conventional foot wearing a low heel.
Figure 28:
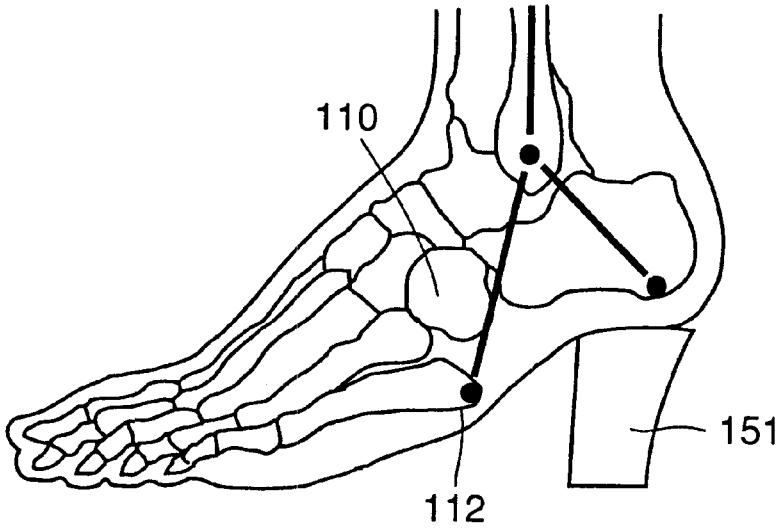
FIG.28 PRIOR ART
FIG. 28 is a schematic diagram for illustrating a state of the tuberosity of fifth metatarsal the conventional foot wearing a high heel.
Figure 29:
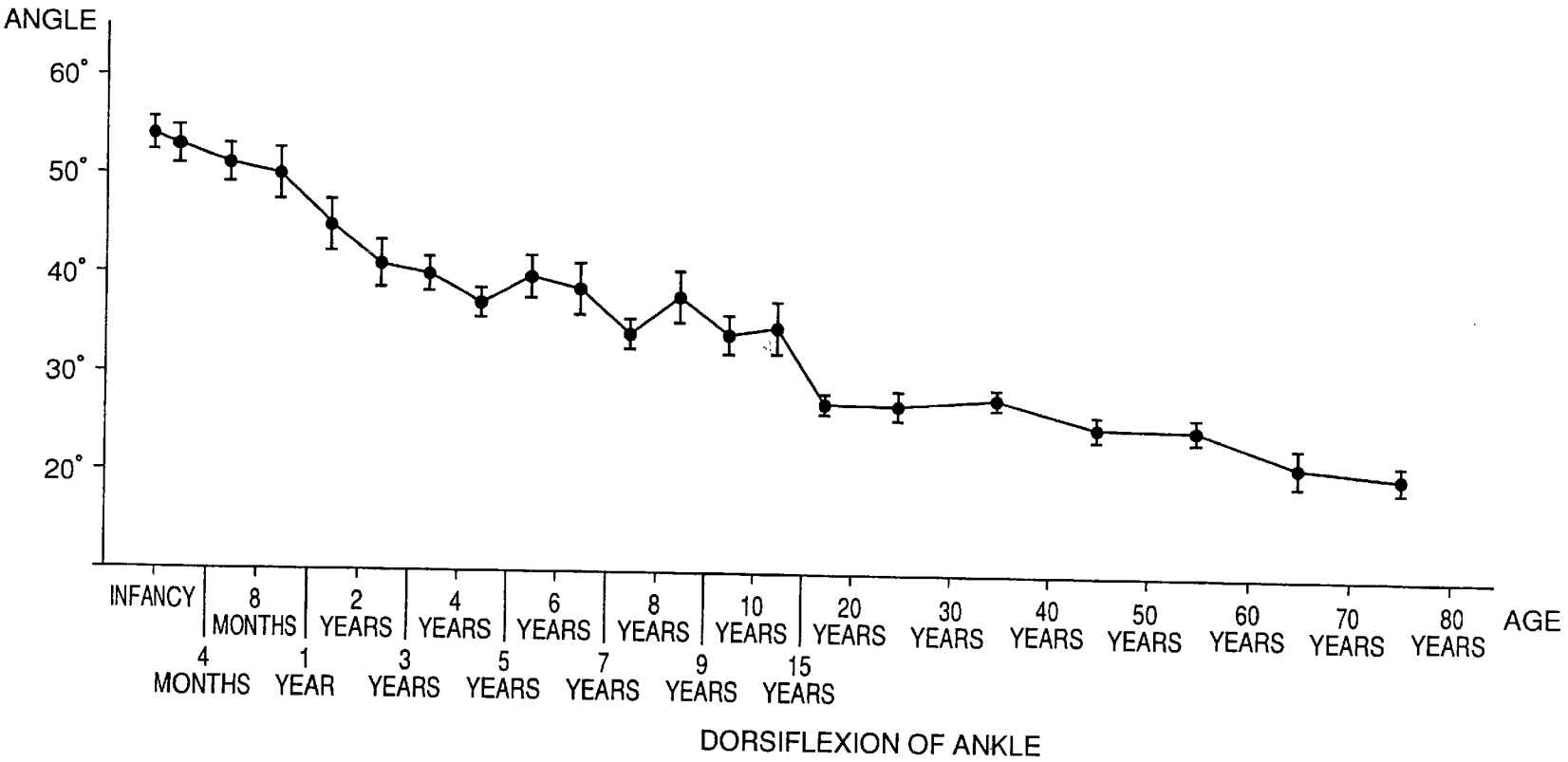
FIG.29 PRIOR ART
FIG. 29 is a correlation diagram showing the relation between the dorsiflexion excursion of the conventional foot and age.
Figure 30:
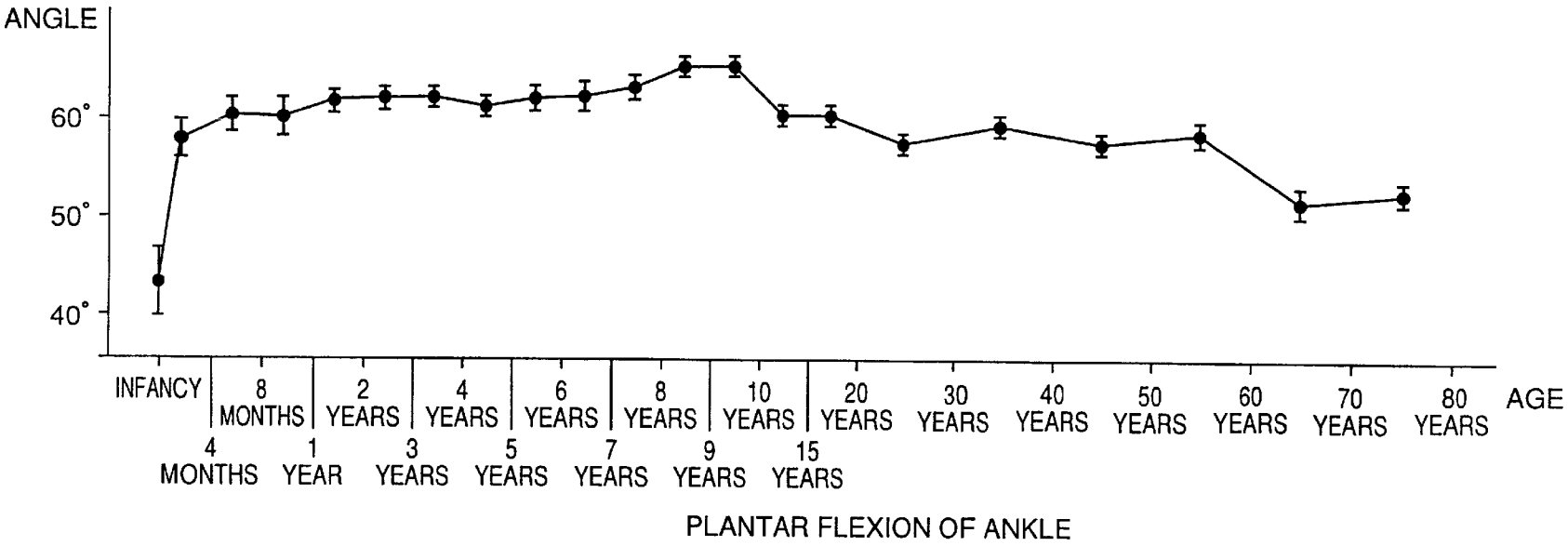
FIG.30 PRIOR ART
FIG. 30 is a correlation diagram showing the relation between the plantar flexion excursion of the conventional foot and age.

The sole 2 according to the first embodiment is so formed that a vertical line from the sustentaculum 106 (see FIG. 24) of the foot to the ground and a vertical line from the tuberosity of fifth metatarsal 112 (see FIG. 25) of the foot to the ground are located on the central surface 4.

When forming the sole 2 so that the vertical line from the sustentaculum of the foot to the ground is located on the central surface 4, it is possible to support the sustentaculum supporting most part of pressure applied to the overall body with the central surface 4 thereby stably supporting the body weight when touching the ground with the central surface 4 for enabling stable standing with only the central surface 4 substantially parallel to the bottom of the foot.

Further, the central surface 4 supports the sustentaculum in walking thereby stabilizing the sustentaculum on a position correctly at 90 degrees with respect to the long axis of the foot with a normal arch. Thus, it is possible to effectively prevent the ligament from chronic tension leading to inflammation of the talocalcanean joint, the talonavicular joint, the calcaneocuboid joint or the like.

When forming the sole 2 so that the vertical line from the tuberosity of fifth metatarsal of the foot to the ground is located on the central surface 4, the tuberosity of fifth metatarsal comes into close contact with the ground to form a base firmly supporting the body weight upon touching the ground with the central surface 4. Also in this case, therefore, it is possible to stably support the body weight when touching the ground with the central surface 4. Further, it is also possible to prevent the ligament from chronic tension when the tuberosity of fifth metatarsal separates from the ground.

According to the first embodiment, the central surface 4 is provided in the range of at least 20% and not more than 45% assuming that the heel is 0% and the toe is 100% in the overall sole 2. More specifically, the central surface 4 is so formed that L1 and L2 shown in FIG. 3 are at least 20% and not more than 45% respectively. If the boundary 10 between the central surface 4 and the rear bottom surface 6 is located on a position of not more than 20% and the boundary 12 between the central surface 4 and the front bottom surface 8 is located on a position exceeding 45%, motion of dorsiflexion and plantar flexion is unbalanced. When the central surface 4 is provided on a position within the range of at least 20% and not more than 45%, therefore, dorsiflexion and plantar flexion can be performed in a well-balanced manner.

It is more preferable that the position of the boundary 10 between the rear bottom surface 6 and the central surface 4 substantially aligns with the position of the vertical line from the sustentaculum of the foot to the ground. Assuming that the distance between the heel (0%) and the toe is 100%, the vertical line from sustentaculum to the ground is located on a relative position of 22% to 28% from the heel in consideration of individual variation.

Further, it is more preferable that the boundary 12 between the central surface 4 and the front bottom surface 8 substantially aligns with the position of the tuberosity of fifth metatarsal of the foot. The tuberosity of fifth metatarsal of the foot is located on a relative position of 35% to 41% from the heel in consideration of individual variation.

Figure 7:
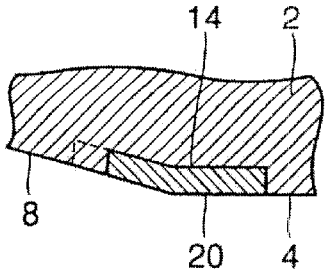
FIG. 7 is a sectional view of the sole according to the first embodiment taken along the line 7 in FIG. 3.

As shown in FIGS. 1, 3 and 7, a concave portion 14 having a trapezoidal plane shape is provided on the outer side of the boundary 12 between the central surface 4 and the front bottom surface 8 to extend over the boundary 12. The concave portion 14 is padded with a first elastic layer 20 made of a softer material as compared with the remaining portions. The first elastic layer 20 is made of polyurethane having hardness of about 50, for example, and the remaining bottom surface portions are made of rubber having hardness of about 90, for example. The first elastic layer 20 is formed to smoothly deform with a load.

Figure 8:
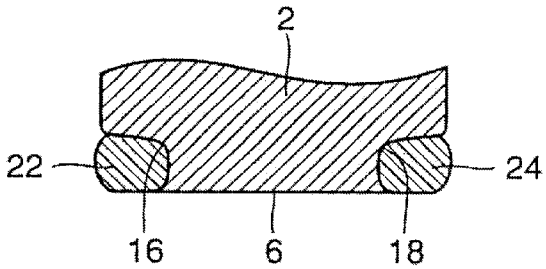
FIG. 8 is a sectional view of the sole according to the first embodiment taken along the line 8 in FIG. 3.
Figure 9:
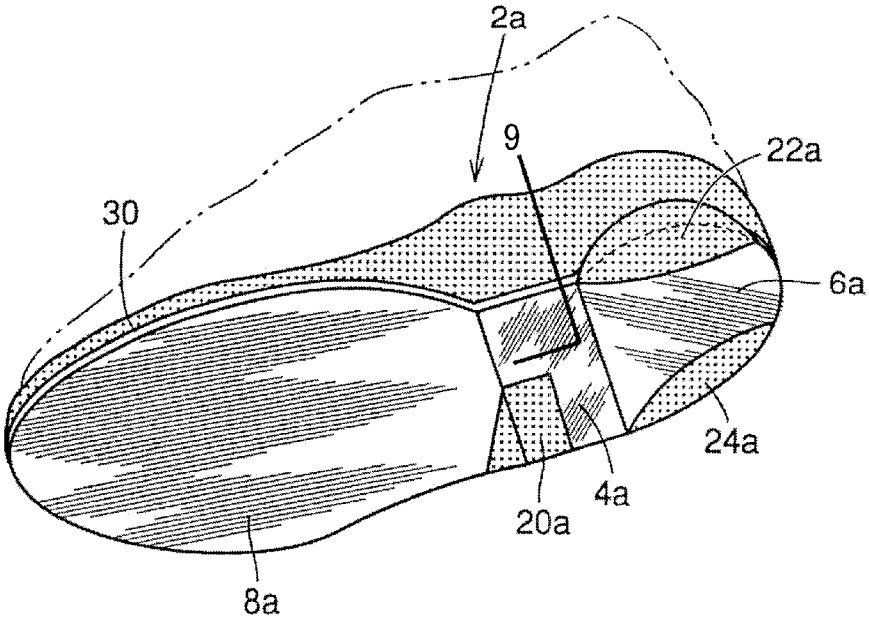
FIG. 9 is a perspective view for illustrating a sole according to a second embodiment of the present invention.
Figure 10:
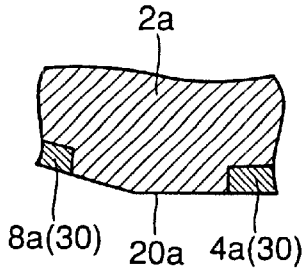
FIGS. 10 and 11 are sectional views for illustrating the sole according to the second embodiment of the present invention.
Figure 11:
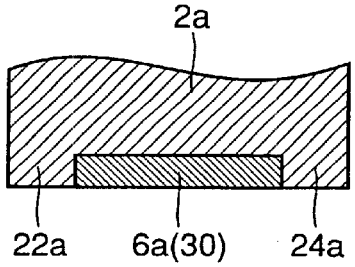

As shown in FIGS. 1, 3 and 8, concave portions 16 and 18 are formed on both sides of the rear bottom surface 6 in a manner scooped out with a spoon. The concave portions 16 and 18 are padded with second elastic layers 22 and 24 made of a softer material as compared with the remaining portions respectively. The second elastic layers 22 and 24 are made of polyurethane having hardness of about 50, for example, similarly to the first elastic layer 20.

Figure 4:
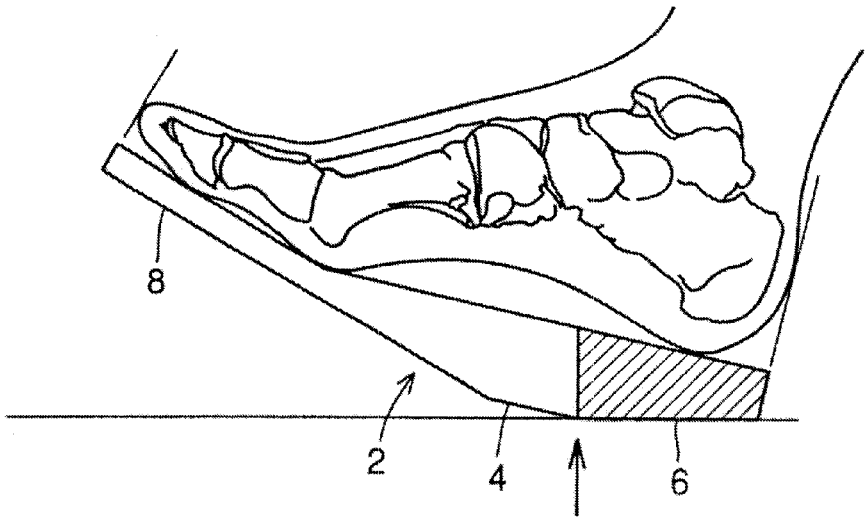
FIG. 4 is a schematic diagram for illustrating a movement for touching the ground with the heel in the first embodiment shown in FIG. 1.
Figure 5:
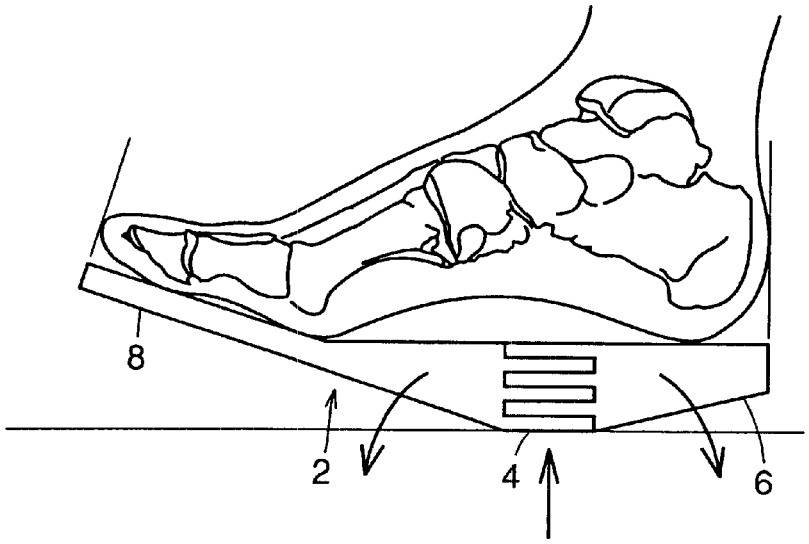
FIG. 5 is a schematic diagram for illustrating a movement for touching the ground with the entire bottom of the foot in the first embodiment shown in FIG. 1.
Figure 6:
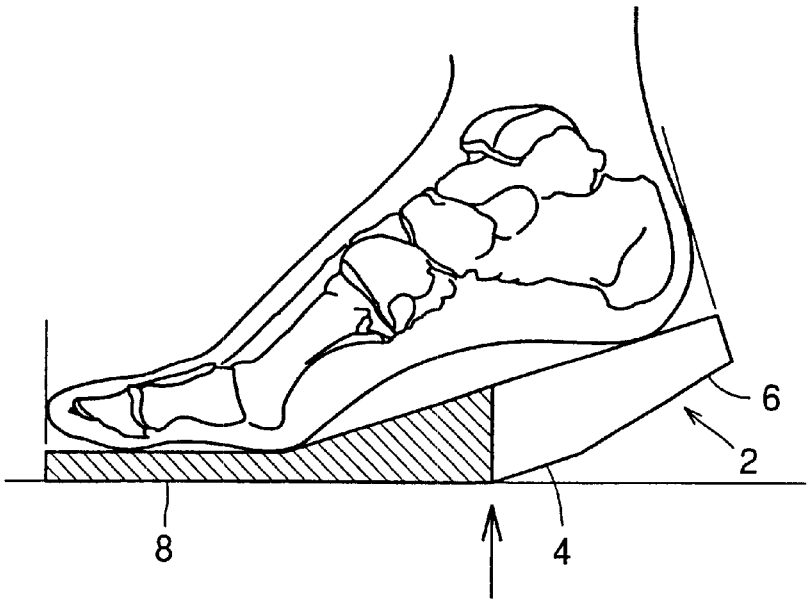
FIG. 6 is a schematic diagram for illustrating a movement for separating the heel from the ground in the first embodiment shown in FIG. 6.

Thus, the sole 2 according to the first embodiment is provided with the first elastic layer 20 having higher flexibility as compared with the remaining portions to extend over the boundary 12 between the central surface 4 and the front bottom surface 8 while the central surface 4, the front bottom surface 8 and the rear bottom surface 6 are formed at the aforementioned angles $\alpha$ and $\beta$ of inclination. In walking, therefore, the rear bottom surface 6 first touches the ground as shown in FIG. 4, then the first elastic layer 20 deforms with the load to perform supination when the central surface 4 touches the ground as shown in FIG. 5, thereafter the body weight moves inward and the front bottom surface 8 finally kicks the ground while performing supination, for readily performing the so-called aori motion of the foot.

The first elastic layer 20 smoothly deforms with the load when the central surface 4 touches the ground, whereby aori motion can be smoothly performed while absorbing a shock on the foot when touching the ground with the outer side of the foot. Further, the foot can grip a projecting portion of the ground with the first elastic layer 20.

In the sole 2 according to the first embodiment, further, the concave portions 16 and 18 formed on the inner and outer end surfaces of the rear bottom surface 6 are padded with the second elastic layers 22 and 24 made of a softer material as compared with the remaining portions, so that the second elastic layers 22 and 24 function similarly to the fatty layer of the heel thereby absorbing a shock and enlarging the surface touching the ground similarly to the fatty layer of the heel deforming in a bare state. Thus, aori motion can be more smoothly performed.

The aforementioned structure is functionally consistent, and it is extremely effective for keeping balance in normal plantar flexion and dorsiflexion of the ankle when simultaneously satisfying the requirement for the position of the central surface 4 (20% to 45% from the heel) and the conditions of the angles $\alpha$ and $\beta$ of the rear bottom surface 6 and the front bottom surface 8 ($\alpha<\beta$, $\beta/\alpha=1.2$ to 2.0, the maximum value of the angle $\beta$ is 30 degrees and the maximum value of the angle $\alpha$ is 20 degrees).

Second Embodiment

In the aforementioned first embodiment, the concave portions 14, 16 and 18 are formed on the sole 2 made of hard rubber and thereafter padded with the first elastic layer 20 and the second elastic layers 22 and 24 respectively. In a second embodiment of the present invention, on the other hand, a sole 2*a* made of a soft material (e.g., polyurethane having hardness of about 50) including a first elastic portion 20*a* and second elastic portions 22*a* and 24*a* is first formed so that a bottom layer 30 made of hard rubber formed with a front bottom surface 8*a*, a central surface 4*a* and a rear bottom surface 6*a* is bonded to portions excluding the first elastic portion 20*a* and the second elastic portions 22*a* and 24*a*.

In this case, manufacturing steps are advantageously simplified as compared with the structure of the first embodiment.

Figure 12:
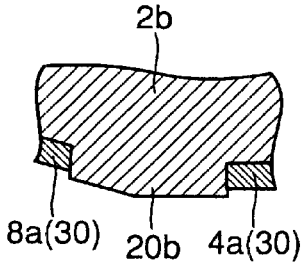
FIGS. 12 and 13 are sectional views for illustrating a modification of the sole according to the second embodiment of the present invention.
Figure 13:
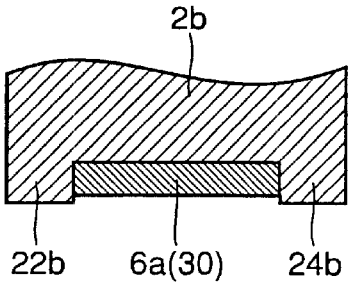

As a modification of the second embodiment, the surface of a sole 2*b* made of a soft material (e.g., polyurethane having hardness of about 50) including a first elastic portion 20*b* and second elastic portions 22*b* and 24*b* may project beyond a bottom layer 30 made of hard rubber formed with a front bottom surface 8*a*, a central surface 4*a* and a rear bottom surface 6*a*, as shown in FIGS. 12 and 13.

Third Embodiment

Figure 14:
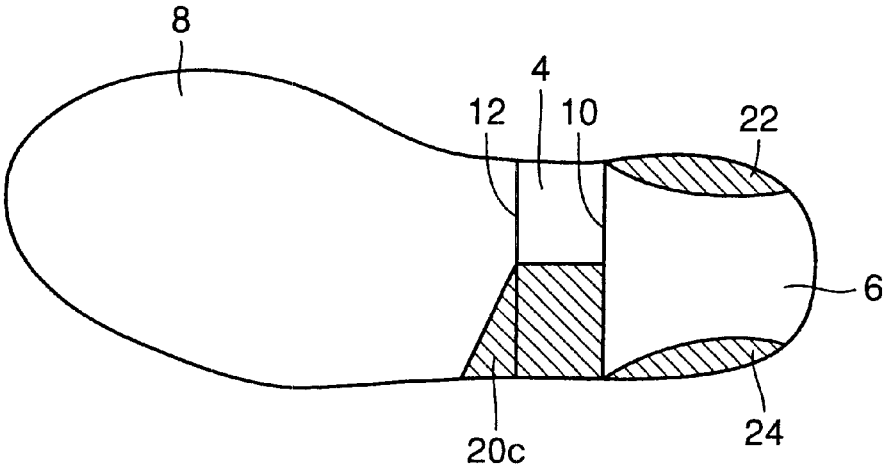
FIG. 14 is a bottom plan view for illustrating a sole according to a third embodiment of the present invention.
Figure 15:
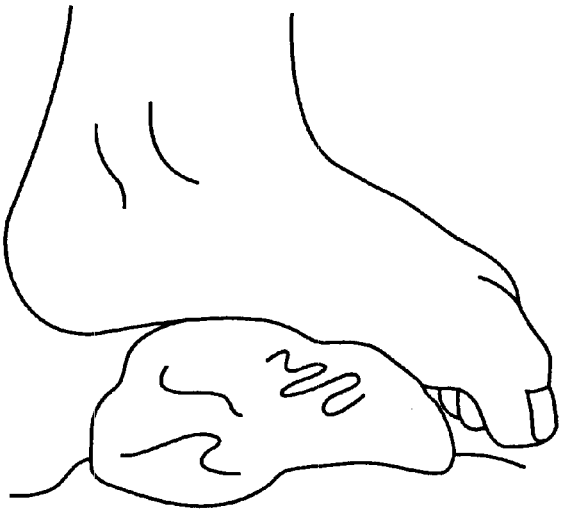
FIG. 15 PRIOR ART
FIG. 15 is a perspective view for illustrating a natural movement of a conventional foot for gripping a projecting portion of the ground with the foot.
Figure 16:
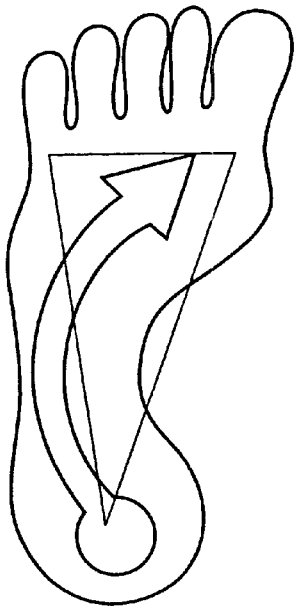
FIG. 16 PRIOR ART
FIG. 16 is a bottom plan view for illustrating a natural movement (aori motion) of the conventional foot.
Figure 17:
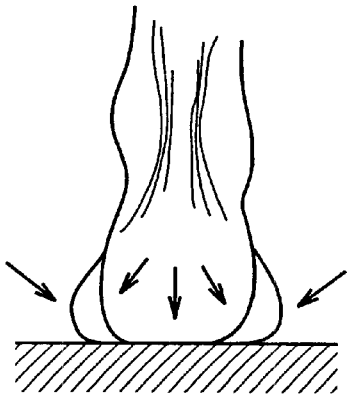
FIG. 17 PRIOR ART
FIGS. 17 and 18 are a rear elevational view and a perspective view for illustrating a natural movement (absorption of a shock and enlargement of a surface touching the ground resulting from deformation of the fatty layer of the heel) of the conventional foot.
Figure 18:
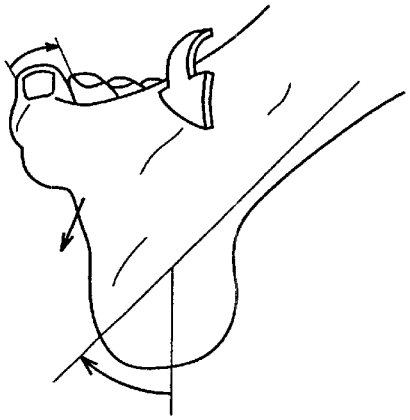
FIG. 18 PRIOR ART
Figure 19A:
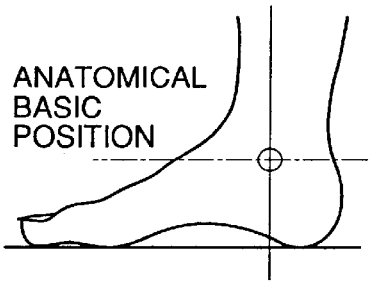
FIG. 19A PRIOR ART
FIG. 19A is a perspective view for illustrating a basic position of the conventional foot.
Figure 19B:
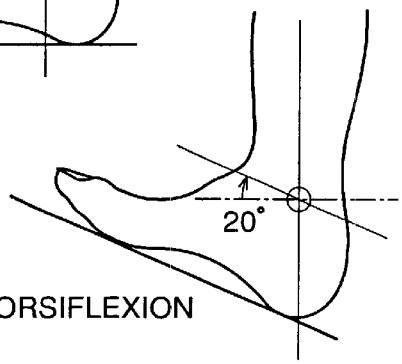
FIG. 19B PRIOR ART
FIGS. 19B and 19C are perspective views for illustrating dorsiflexion and plantar flexion of the conventional foot respectively.
Figure 19C:
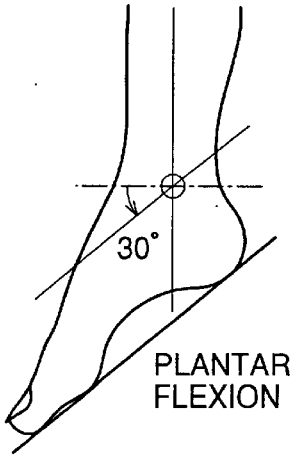
FIG. 19C PRIOR ART
Figure 20A:
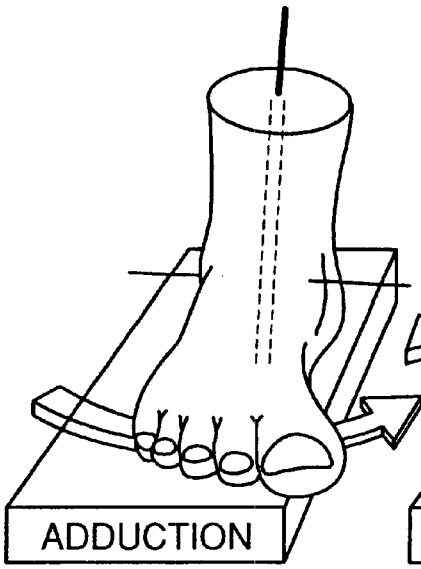
FIG.20A PRIOR ART
FIGS. 20A and 20B are perspective view for illustrating adduction and abduction of the conventional foot respectively.
Figure 20B:
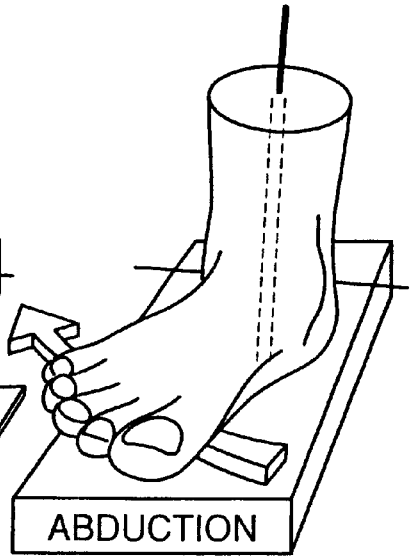
FIG.20B PRIOR ART
Figure 21A:
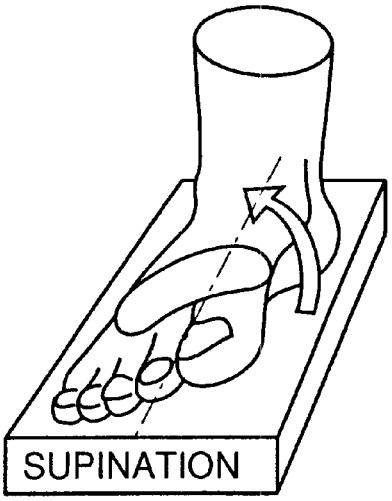
FIG.21A PRIOR ART
FIGS. 21A and 21B are perspective views for illustrating supination and pronation of the conventional foot respectively.
Figure 21B:
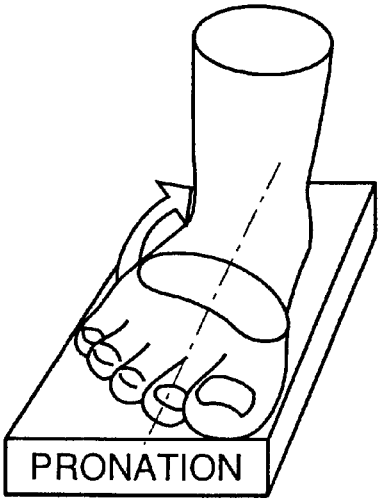
FIG.21B PRIOR ART
Figure 22A:
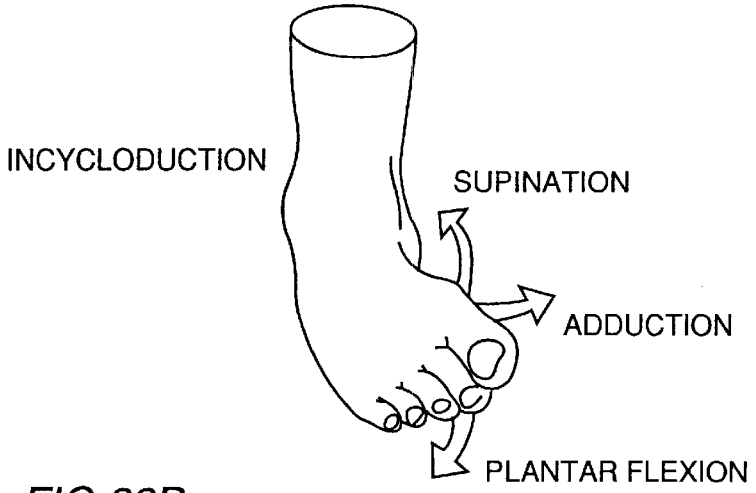
FIG.22A PRIOR ART
FIGS. 22A and 22B are perspective views for illustrating incycloduction and excycloduction of the conventional foot respectively.
Figure 22B:
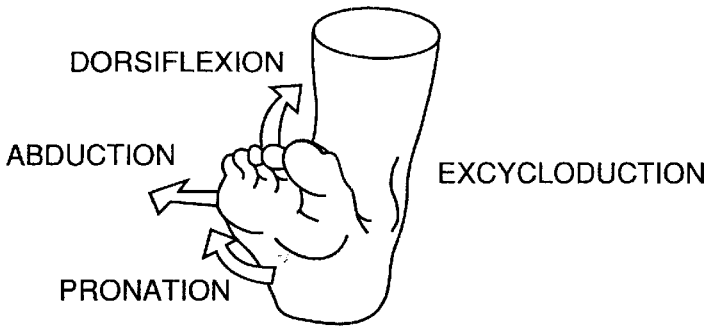
FIG.22B PRIOR ART
Figure 23:
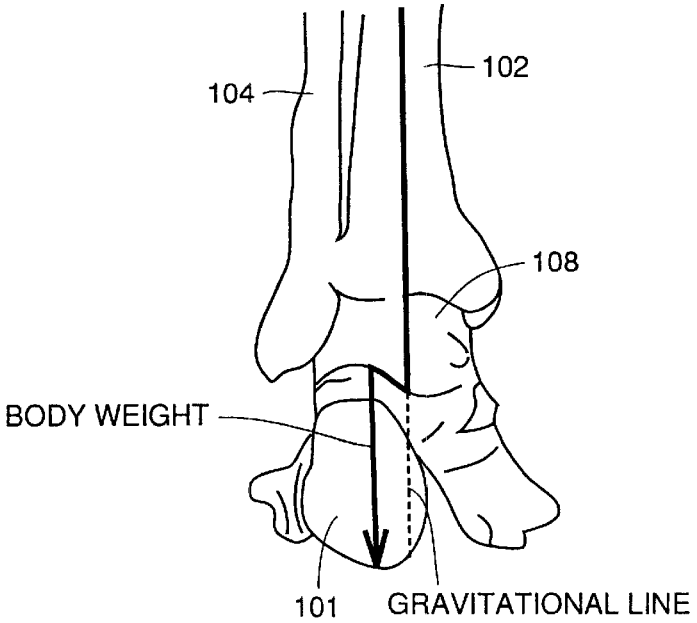
FIG.23 PRIOR ART
FIG. 23 is a schematic diagram for illustrating a conventional path transmitting body weight.

According to a third embodiment of the present invention, the position of a first elastic layer 20*c* is spread toward the boundary 10 between a central surface 4 and a rear bottom surface 6 as shown in FIG. 14, dissimilarly to the structure of the first embodiment shown in FIG. 3. Also in this case, effects similar to those of the first embodiment can be attained.

Although the present invention has been described and illustrated in detail, it is clearly understood that the same is by way of illustration and example only and is not to be taken by way of limitation, the spirit and scope of the present invention being limited only by the terms of the appended claims.

Also when applying the sole according to each of the aforementioned embodiments to a sandal, for example, similar effects can be attained. The first elastic layer smoothly deforms with the load when the central surface touches the ground, whereby aori motion can be smoothly performed while absorbing a shock on the foot when the foot touches the ground with the outer side thereof and the foot can grip a projecting portion of the ground.

While each of the first elastic layer 20 and the first elastic portions 20*a* and 20*b* has a trapezoidal plane shape in the aforementioned embodiments, the present invention is not restricted to this but effects similar to the above can be attained with a first elastic layer (portion) having another shape such as a circular or polygonal shape so far as the first elastic layer (portion) extends over the boundary 12 between the central surface 4 and the front bottom surface 8.

What is claimed is:

1. A sole comprising:

a central surface substantially parallel to the bottom of a wearer's foot;

a front bottom surface having a first angle of inclination with respect to said central surface;

a rear bottom surface having a second angle of inclination with respect to said central surface, wherein a first boundary between the central surface and the front bottom surface;

a second boundary between the central surface and the rear bottom surface; and a first elastic layer made of a material having higher flexibility as compared with the front bottom surface, the rear bottom surface and the central surface provided on an outer side of the first boundary to extend over the boundary, wherein the first elastic layer is formed to enable aori motion of the foot.

2. The sole according to claim 1, wherein second elastic layers made of a material having higher flexibility as compared with the remaining portions are provided on both inner and outer end surfaces of said rear bottom surface.

3. The sole according to claim 1, wherein a vertical line from the sustentaculum of said wearer's foot to the ground and a vertical line from the tuberosity of fifth metatarsal of said wearer's foot to the ground are located on said central surface.

4. The sole according to claim 1, wherein said central surface is provided in the range of at least 20% in length and not more than 45% in length assuming that the heel is 0% and the toe is 100% in overall length of said sole.

5. The sole according to claim 1, wherein a vertical line from the sustentaculum of said wearer's foot to the ground is substantially located on the second boundary between said central surface and said rear bottom surface and a vertical line from the tuberosity of fifth metatarsal of said wearer's foot to the ground is substantially located on the first boundary between said central surface and said front bottom surface.

6. The sole according to claim 5, wherein the boundary between said central surface and said rear bottom surface is located on a position of 22% to 28% in length and the boundary between said central surface and said front bottom surface is located on a position of 35% to 41% in length assuming that the heel is 0% and the toe is 100% of overall length of said sole.

7. The sole according to claim 1, wherein said first angle of inclination of said front bottom surface is greater than said second angle of inclination of said rear bottom surface, and said first angle of inclination of said front bottom surface is 1.2 times to twice said second angle of inclination of said rear bottom surface, the maximum value of said first angle of inclination of said front bottom surface is 30 degrees of the normal plantar flexion excursion of the ankle, and the maximum value of said second angle of inclination of said rear bottom surface is 20 degrees of the normal dorsiflexion excursion of the ankle.

* * * * *